US008333081B2

(12) United States Patent
Han et al.

(10) Patent No.: US 8,333,081 B2
(45) Date of Patent: Dec. 18, 2012

(54) ICE DISPENSING TECHNOLOGY

(75) Inventors: Seung Do Han, Seoul (KR); Ho Youn Lee, Seoul (KR); Young Jin Kim, Seoul (KR); Tae Hee Lee, Seoul (KR); Sung Yong Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 779 days.

(21) Appl. No.: 12/488,634

(22) Filed: Jun. 22, 2009

(65) Prior Publication Data

US 2010/0122547 A1 May 20, 2010

(30) Foreign Application Priority Data

Nov. 14, 2008 (KR) ..... 10-2008-0113685

(51) Int. Cl.
*F25C 1/00* (2006.01)
*F25B 49/00* (2006.01)
*B67D 7/06* (2010.01)

(52) U.S. Cl. ..... 62/135; 62/131; 222/23

(58) Field of Classification Search ..... 62/131, 62/340, 441, 135; 222/52, 23, 146.6, 504; 700/275

See application file for complete search history.

(56) References Cited

U.S. PATENT DOCUMENTS

| | | | | |
|---|---|---|---|---|
| 4,090,641 | A | 5/1978 | Lindenschmidt | |
| 5,474,213 | A | 12/1995 | Unger | |
| 5,838,125 | A * | 11/1998 | Choi | 318/285 |
| 2005/0044874 | A1 | 3/2005 | Lee et al. | |
| 2006/0144075 | A1 * | 7/2006 | Bowen et al. | 62/344 |
| 2007/0119204 | A1 * | 5/2007 | Kwon | 62/340 |

FOREIGN PATENT DOCUMENTS

EP 1510766 A1 3/2005

OTHER PUBLICATIONS

European Search Report dated May 9, 2011 for Application No. EP09009449, 5 pages.

* cited by examiner

*Primary Examiner* — Chen Wen Jiang
(74) *Attorney, Agent, or Firm* — Fish & Richardson P.C.

(57) ABSTRACT

An ice-making device includes a duct through which ice is dispensed and a duct-covering part opening and closing the duct. A sensor part senses whether the duct-covering part closes the duct and a control part controls the duct-covering part to open the duct when the sensor part senses that the duct-covering part fails to close the duct and the duct-covering part has been attempting to close the duct for at least a preset period of time.

18 Claims, 6 Drawing Sheets

ICE DISPENSING TECHNOLOGY

CROSS-REFERENCE TO RELATED APPLICATIONS

The present application claims priority under 35 U.S.C. 119 and 35 U.S.C. 365 to Korean Patent Application No. 10-2008-0113685 (filed on Nov. 14, 2008), which is hereby incorporated by reference in its entirety.

FIELD

The present disclosure relates to ice dispensing technology.

BACKGROUND

A refrigerator is a home appliance that can store foods in a freezing state or a refrigeration state. A refrigerator may include a dispenser that can dispense ice and/or water to an outside of the refrigerator. The refrigerator provided with the dispenser includes devices for making and dispensing the ice.

SUMMARY

In one aspect, an ice-making device includes a duct through which ice is dispensed, a duct-covering part configured to open and close the duct, and a sensor part configured to sense whether the duct-covering part is positioned to close the duct. The ice-making device also includes a control part configured to control the duct-covering part to open the duct when the sensor part senses that the duct-covering part fails to close the duct and the duct-covering part has been attempting to close the duct for at least a preset period of time.

Implementations may include one or more of the following features. For example, the sensor part may include a magnet coupled to one of a side of the duct and a side of the duct-covering part and a hall sensor that is coupled to the other of the side of the duct and the side of the duct-covering part and that is configured to sense a magnetic field of the magnet. The magnet and the hall sensor may be positioned such that, when the duct-covering part is positioned to close the duct, the magnet and the hall sensor contact and, when the duct-covering part is positioned to open the duct, the magnet and the hall sensor fail to contact.

In some implementations, the duct-covering part may include a duct cap and a cap motor configured to rotate the duct cap to open and close the duct. In these implementations, the control part may be configured to rotate the cap motor in a first direction to cause the cap motor to rotate the duct cap to open the duct and rotate the cap motor in a second direction to cause the cap motor to rotate the duct cap to close the duct. The second direction may be different than the first direction.

In another aspect, an ice-making device includes a duct through which ice is dispensed, a duct-covering part configured to open and close the duct, and a sensor part configured to sense a position of the duct-covering part relative to the duct. The ice-making device also includes a control part configured to control the duct-covering part to repeat at least once an operation of opening and closing the duct when the sensor part senses that the duct-covering part fails to reach a closing position in which the duct-covering part closes the duct and the duct-covering part has been attempting to close the duct for at least a preset period of time.

Implementations may include one or more of the following features. For example, the control part may be configured to, after controlling the duct-covering part to repeat the operation of opening and closing the duct, reduce the preset period of time used in determining whether to repeat the operation of opening and closing the duct. The control part may be configured to gradually reduce the preset period of time used in determining whether to repeat the operation of opening and closing the duct each time the operation of opening and closing the duct is repeated.

The ice-making device may include a warning part configured to output a warning to a user. The control part may be configured to determine whether the operation of opening and closing the duct has been repeated a preset number of times and control the warning part to output the warning in response to a determination that the operation of opening and closing the duct has been repeated the preset number of times.

The sensor part may include a magnet coupled to one of a side of the duct and a side of the duct-covering part and a hall sensor that is coupled to the other of the duct and the side of the duct-covering part and that is configured to sense a magnetic field of the magnet. The magnet and the hall sensor may be positioned such that, when the duct-covering part is positioned to close the duct, the magnet and the hall sensor contact and, when the duct-covering part is positioned to open the duct, the magnet and the hall sensor fail to contact.

In some implementations, the duct-covering part may include a duct cap and a cap motor configured to rotate the duct cap to open and close the duct. In these implementations, the control part may be configured to rotate the cap motor in a first direction to cause the cap motor to rotate the duct cap to open the duct and rotate the cap motor in a second direction to cause the cap motor to rotate the duct cap to close the duct. The second direction may be different than the first direction.

The sensor part may include a magnet coupled to a side of the duct-covering part and a hall sensor that is configured to sense a magnetic field of the magnet and that is configured to sense whether the duct-covering part is in a position to close the duct based on whether the magnetic field of the magnet is relatively weak or relatively strong.

In yet another aspect, a method of controlling an ice-making device includes controlling, using a control part, a duct-covering part to open a duct to allow dispensing of ice. Subsequent to dispensing ice through the duct, the method includes controlling, using the control part, the duct-covering part to close the duct. In response to controlling the duct-covering part to close the duct, the method includes sensing, using a sensor part, whether the duct-covering part is in a position that closes the duct and determining, using the control part, whether a preset period of time has passed since controlling the duct-covering part to close the duct. In response to sensing that the duct-covering part is not in a position that closes the duct and determining that the preset period of time has passed since controlling the duct-covering part to close the duct, the method includes controlling, using the control part, the duct-covering part to reopen the duct.

Implementations may include one or more of the following features. For example, the method may include controlling, using the control part, the duct-covering part to attempt to close the duct again after controlling the duct-covering part to reopen the duct. The method also may include controlling, using the control part, the duct-covering part to repeatedly open the duct and attempt to close the duct until the sensor part senses that the duct-covering part is in a position that closes the duct prior to the control part determining that the duct-covering part has been attempting to close the duct for the preset period of time.

Further, the method may include determining, using the control part, whether, in attempting to close the duct, an operation to open and close the duct has been repeated a preset number of times and using the control part to stop controlling the duct-covering part to repeatedly open the duct and attempt to close the duct in response to a determination that an operation to open and close the duct has been repeated the preset number of times. After controlling the duct-covering part to repeat an operation of opening and closing the duct, the method may include reducing the preset period of time used in determining whether to repeat the operation of opening and closing the duct. The method may include gradually reducing the preset period of time used in determining whether to repeat the operation of opening and closing the duct each time the operation of opening and closing the duct is repeated.

In some implementations, the duct-covering part may include a duct cap and a cap motor configured to rotate the duct cap to open and close the duct. In these implementations, the method may include controlling, using the control part, the cap motor to rotate in a first direction to cause the cap motor to rotate the duct cap to open the duct, and controlling, using the control part, the cap motor to rotate in a second direction to cause the cap motor to rotate the duct cap to close the duct. The second direction may be different than the first direction.

In some examples, the method may include determining, using the control part, whether, in attempting to close the duct, an operation to open and close the duct has been repeated a preset number of times, and outputting, using a warning part, a warning to a user in response to a determination that an operation to open and close the duct has been repeated the preset number of times.

The details of one or more implementations are set forth in the accompanying drawings and the description below. Other features will be apparent from the description and drawings, and from the claims.

DETAILED DESCRIPTION

Figure 1:
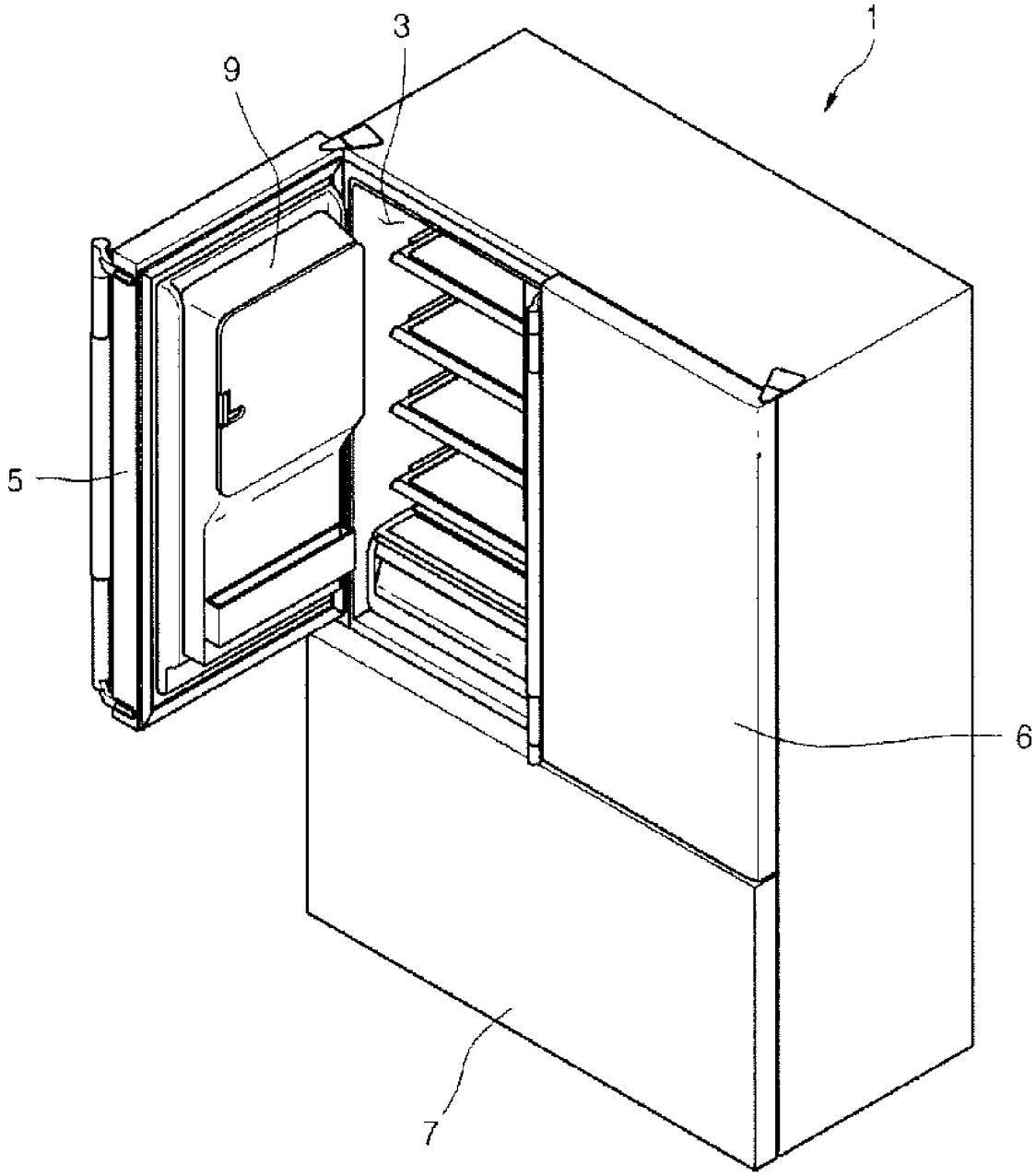
FIG. 1 is a perspective view illustrating a refrigerator with an ice-making device.
Figure 2:
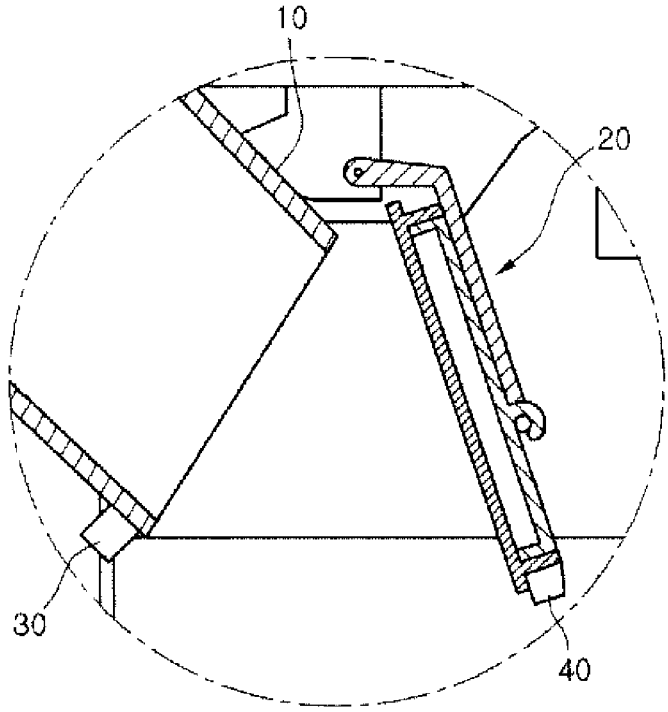
FIG. 2 is a cross-sectional view illustrating a part of an ice-making device.
Figure 3:
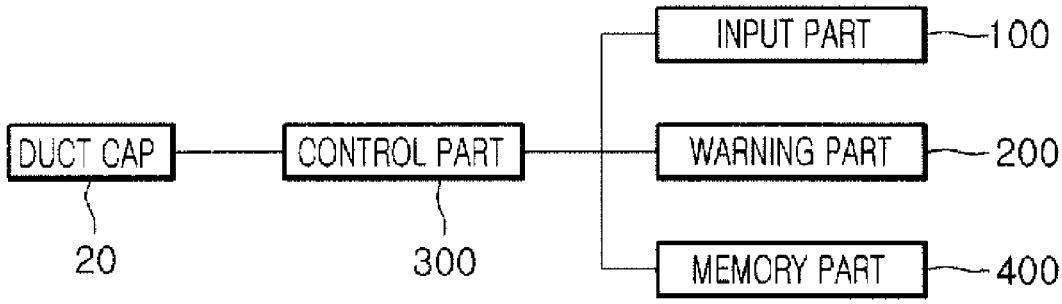
FIG. 3 is a block diagram illustrating configuration of an ice dispensing control system.

FIG. 1 illustrates an example of a refrigerator with an ice-making device. FIG. 2 illustrates a cross-section of an example of a part of an ice-making device. FIG. 3 illustrates an example configuration of an ice dispensing control system.

Referring to FIG. 1, a refrigerator compartment 3 and a freezer compartment are disposed in a main body 1. The refrigerator compartment 3 and the freezer compartment, where foods are stored, are arranged vertically in the main body 1, with the refrigerator compartment 3 being positioned above the freezer compartment. The refrigerator compartment 3 is opened and closed by refrigerator compartment doors 5 and 6 and the freezer compartment is opened and closed by a freezer compartment door 7.

An ice-making chamber 9 is provided to an inner surface of the refrigerator compartment door 5 (hereinafter, referred to as a "door"). The ice-making chamber 9 is separated from the refrigerator compartment 3, and an ice-making device (not shown) for making ice is disposed in the ice-making chamber 9.

A front surface of the door 5 is provided with a dispenser (not shown). The dispenser is used to dispense water and/or ice without opening the door 5.

Referring to FIG. 2, an ice duct 10 is disposed in the door 5. The ice duct 10 is used to dispense ice made by the ice-making device to an outside of the refrigerator, that is, to the outside of the refrigerator through the dispenser which transports ice through the door 5 when the door 5 is in a closed positioned. To this end, a first end of the ice duct 10 communicates with the ice-making device and a second end of the ice duct 10 communicates with the dispenser.

A duct cap 20 opens and closes an end of the ice duct 10 adjacent to the dispenser (e.g., the second end of the ice duct 10 that communicates with the dispenser). One end of the duct cap 20 rotates about the other end to open and close the ice duct 10. For example, the duct cap 20 may be rotated by a solenoid valve or a motor.

The ice duct 10 and the duct cap 20 are provided with a hall sensor 30 and a magnet 40, respectively. In the state where the duct cap 20 closes the ice duct 10, the hall sensor 30 and the magnet 40 may be disposed at a position where the ice duct 10 faces the duct cap 20. The hall sensor 30 and the magnet 40 sense a position of the duct cap 20 relative to the ice duct 10. More particularly, the hall sensor 30 provided to the ice duct 10 senses strength (e.g., presence or absence) of a magnetic field of the magnet 40 provided to the duct cap 20 and, thereby, senses the position of the duct cap 20 relative to the ice duct 10. When the duct cap 20 closes the ice duct 10, the hall sensor 30 senses a relatively strong (e.g., a present) magnetic field and detects that the duct cap 20 is in a position to close the ice duct 10. When the duct cap 20 opens the ice duct 10, the hall sensor 30 senses a relatively weak (e.g., an absent) magnetic field and detects that the duct cap 20 is in a position to open the ice duct 10.

Referring to FIG. 3, an input part 100 receives an operation signal for dispensing ice through the dispenser. A warning part 200 displays whether the duct cap 20 is in abnormal operation. The warning part 200 may display the abnormal operation of the duct cap 20 using a lamp on/off, display of characters or symbols, any type of visual display, or an audible output (e.g., a voice output).

A control part 300 (e.g., an electronic controller, a processor, etc.) controls the dispensing of ice through the dispenser. For instance, the control part 300 rotates the duct cap 20 to close or open the ice duct 10 according to an operation signal input to the input part 100.

When abnormal operation of the duct cap 20 is sensed when the duct cap 20 is attempting to close the ice duct 10, the control part 300 controls the duct cap 20 to open the ice duct 10. In some implementations, the control part 300 controls the duct cap 20 to repeat opening and closing operation of the ice duct 10 at least one time until the duct cap 20 operates normally. Abnormal operation of the duct cap 20 is detected when the hall sensor 30 fails to sense that the duct cap 20 is moved from a position where the duct cap 20 opens the ice duct 10 to a closing position for at least a preset time during which the duct cap 20 is attempting to close the ice duct 10. The abnormal operation of the duct cap 20 may be detected when an operation time for the duct cap 20 to rotate from the position where the duct cap 20 opens the ice duct 10 to the position where the duct cap 20 closes the ice duct 10 is greater than the preset time. For example, when ice is caught between the ice duct 10 and the duct cap 20, the duct cap 20 fails to close the ice duct 10 completely. Thus, the hall sensor 30 fails to sense that the duct cap 20 arrives at the position where the duct cap 20 closes the ice duct 10 from the open position prior to the operation time expiring.

When an abnormal operation of the duct cap 20 is sensed and the duct cap 20 repeats the opening and closing operation for the ice duct 10, the control part 300 controls the duct cap 20 to gradually reduce the operation time of the duct cap 20. For instance, as the repeated number of opening and closing operations of the duct cap 20 for the ice duct 10 increases, possibility that a foreign substance is removed between the ice duct 10 and the duct cap 20 also increases. Thus, gradually reducing the opening and closing time of the duct cap 20 for the ice duct 10 reduces an amount of air in the ice-making device that escapes through the ice duct 10 to the outside by the rotation of the duct cap 20 opening and closing the ice duct 10. In this regard, leakage of cold air from the ice-making chamber may be reduced when attempting to correct abnormal operation of the duct cap 20.

When the operation of the duct cap 20 opening and closing the ice duct 10 is repeated a preset number of times and the hall sensor 30 still fails to sense that the duct cap 20 moves from the position where the duct cap 20 opens the ice duct 10 to the closing position before the set time is over, the control part 300 controls the warning part 200 to provide a warning indicating abnormal operation of the duct cap 20. Providing the warning may alert a user to the abnormal operation of the duct cap 20 and, thereby, allow the user to correct the abnormal operation (e.g., remove an ice piece that is preventing the duct cap 20 from closing). This may result in correction of the abnormal operation more quickly and, therefore, reduce an amount of cold air that leaks from the ice-making chamber due to the abnormal operation.

The set time and the set number of times are stored in a memory part 400 (e.g., a random access memory, read only memory, or any type of electronic storage device) and may be user-configurable. The memory part 400 may store the operation times of the duct cap 20 depending on the set number.

Figure 4:
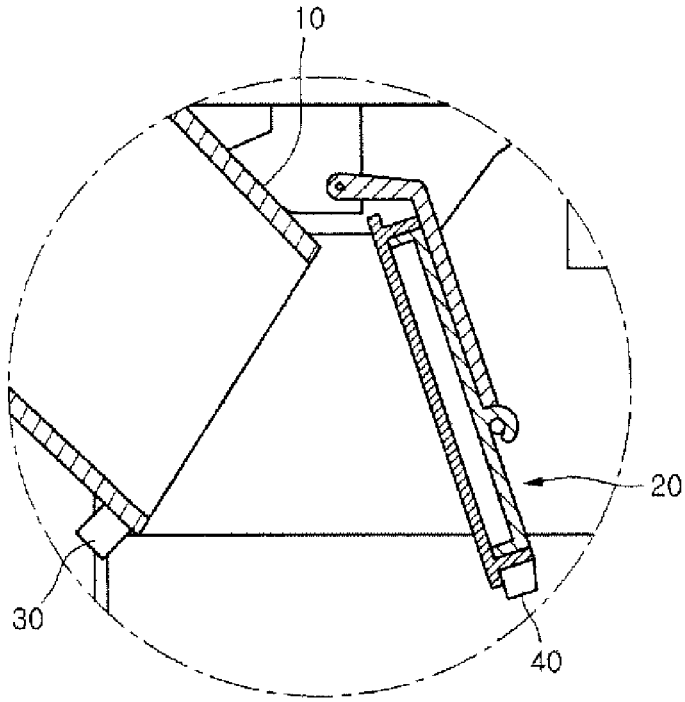
FIGS. 4 to 6 are views illustrating operation of an ice-making device.
Figure 5:
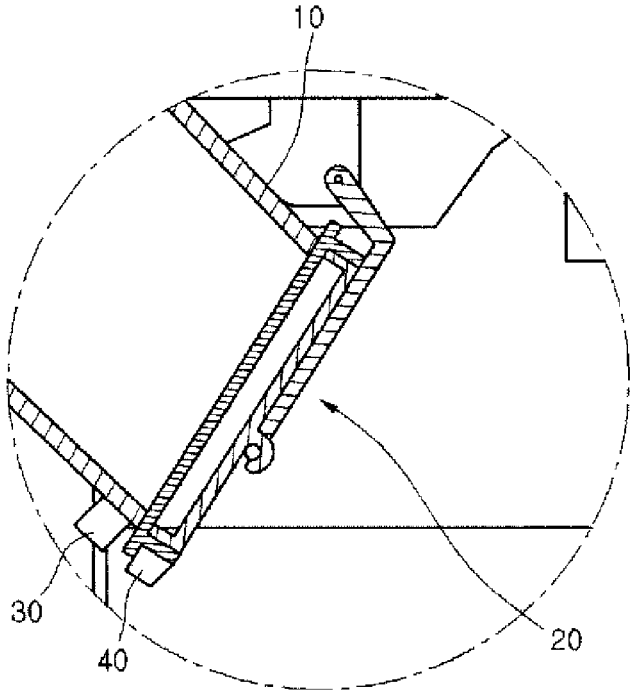
Figure 6:
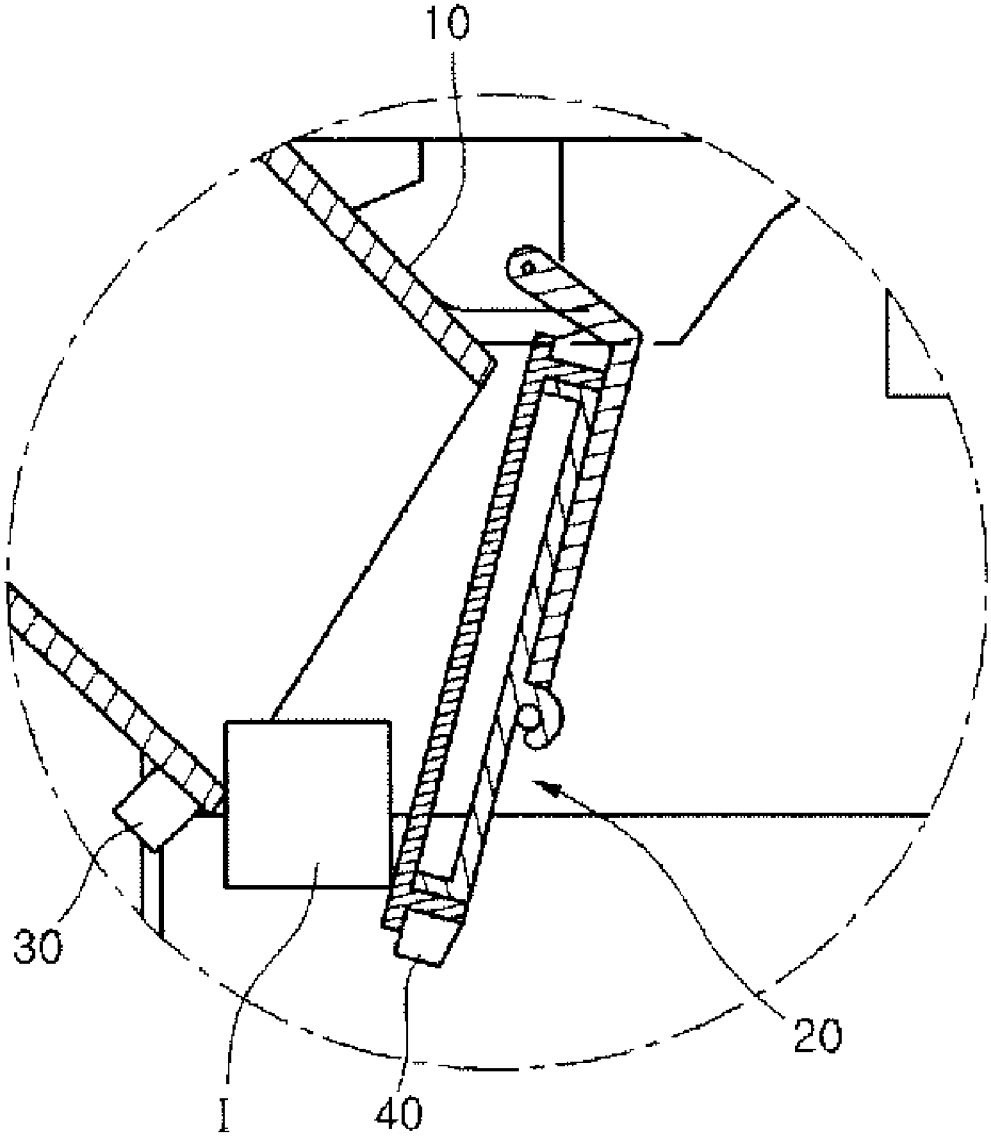

FIGS. 4 to 6 illustrate example operation of an ice-making device. Referring to FIG. 4, the input part 100 (refer to FIG. 3) receives an operation signal for dispensing ice through the dispenser, and the control part 300 (refer to FIG. 3) controls the duct cap 20 to rotate to open the ice duct 10 in response to the operation signal for dispensing ice through the dispenser. Thus, the ice made at the ice-making device is dispensed through the ice duct 10. At this point, the hall sensor 30 senses that the magnetic field of the magnet 40 of the duct cap 20 is relatively weak (e.g., absent or less than a threshold), and thus senses that the duct cap 20 is disposed at the position of opening the ice duct 10.

Referring to FIG. 5, when the dispensing of the ice through the ice duct 10 is finished, the control part 300 controls the duct cap 20 to rotate to close the ice duct 10. Thus, the ice duct 10 is closed to finish the dispensing of the ice through the ice duct 10. At this point, the hall sensor 30 senses that the magnetic field of the magnet 40 of the duct cap 20 is relatively strong (e.g., present or greater than a threshold), and thus senses the duct cap 20 is disposed at the position of closing the ice duct 10.

While the control part 300 controls the duct cap 20 to close the ice duct 10, when an ice piece I is caught between the ice duct 10 and the duct cap 20, the duct cap 20 fails to close the ice duct 10 completely. Thus, the hall sensor 30 senses that the magnetic field of the magnet 40 of the duct cap 20 is relatively weak (e.g., absent or less than a threshold) and thus senses that the duct cap 20 is not disposed at the position of closing the ice duct 10. Based on detecting that the duct cap 20 is not disposed at the position of closing the ice duct 10, the control part 300 controls the duct cap 20 to rotate to open the ice duct 10 or controls the duct cap 20 to rotate to open and close the ice duct 10 a set number of times.

Figure 7:
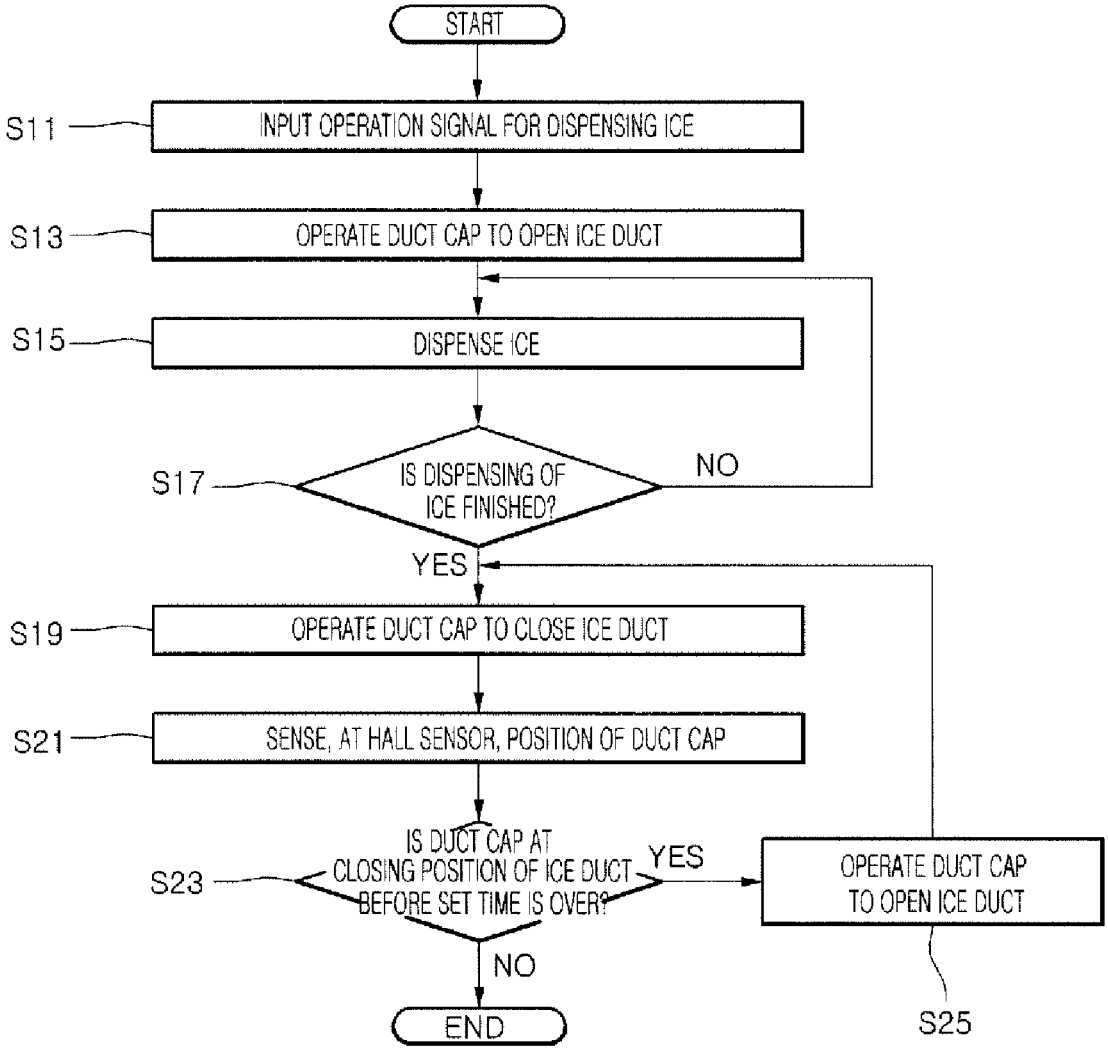
FIG. 7 is a flowchart illustrating a method of controlling an ice-making device.

FIG. 7 illustrates an example of a method of controlling an ice-making device. Referring to FIG. 7, the input part 100 receives an operation signal starting the dispensing of ice through the dispenser (S11). The input part 100 may receive the operation signal starting the dispensing of the ice through the dispenser by receiving a user's press of an operation button (not shown) or receiving a user's press of a lever (not shown) with a container for receiving ice.

When the dispensing of the ice starts (S11), the control part 300 controls the operation of the duct cap 20 to open the ice duct 10 (S13). After the ice duct 10 is opened by the duct cap 20 (S13), the ice is dispensed through the ice duct 10 (S15).

Then, it is determined whether the dispensing of the ice through the ice duct 10 is finished (S17). For example, whether the dispensing of the ice through the ice duct 10 is finished may be determined according to whether the input part 100 receives an operation signal finishing the dispensing of the ice, according to whether the input part 100 further receives the operation signal for dispensing the ice (e.g., whether a user continues to supply a constant pressing force to a dispensing control button or lever), or according to whether the time for dispensing the ice, set according to the operation signal dispensing the ice and input to the input part 100, is finished.

When it is determined that the dispensing of the ice through the ice duct 10 is finished (S17), the control part 300 controls the operation of the duct cap 20 to close the ice duct 10 (S19). Thus, the duct cap 20 operates to close the ice duct 10.

When the duct cap 20 starts to operate to close the ice duct 10 (S19), the hall sensor 30 senses a position of the duct cap 20, e.g., a position of the duct cap 20 relative to the ice duct 10 (S21). The sensing of the position of the duct cap 20 (S21) is performed by sensing, at the hall sensor 30, a magnetic field of the magnet 40 of the duct cap 20.

Based on the sensing (S21), it is determined whether the hall sensor 30 senses that the duct cap 20 has moved to the closing position from the position where the duct cap 20 opens the ice duct 10 prior to a set time expiring (S23) When it is determined that the hall sensor 30 senses that the duct cap 20 is disposed at the closing position prior to the set time expiring (S23), the duct cap 20 has operated normally to close the ice duct 10, and thus the operation of the duct cap 20 is finished.

When it is determined that the hall sensor 30 fails to sense that the duct cap 20 is disposed at the closing position prior to the set time expiring (S23), the control part 300 controls the duct cap 20 to operate to open the ice duct 10 (S25). Then, the control part 300 controls the duct cap 20 such that operations associated with reference numerals (S19) to (S23) are repeated.

Figure 8:
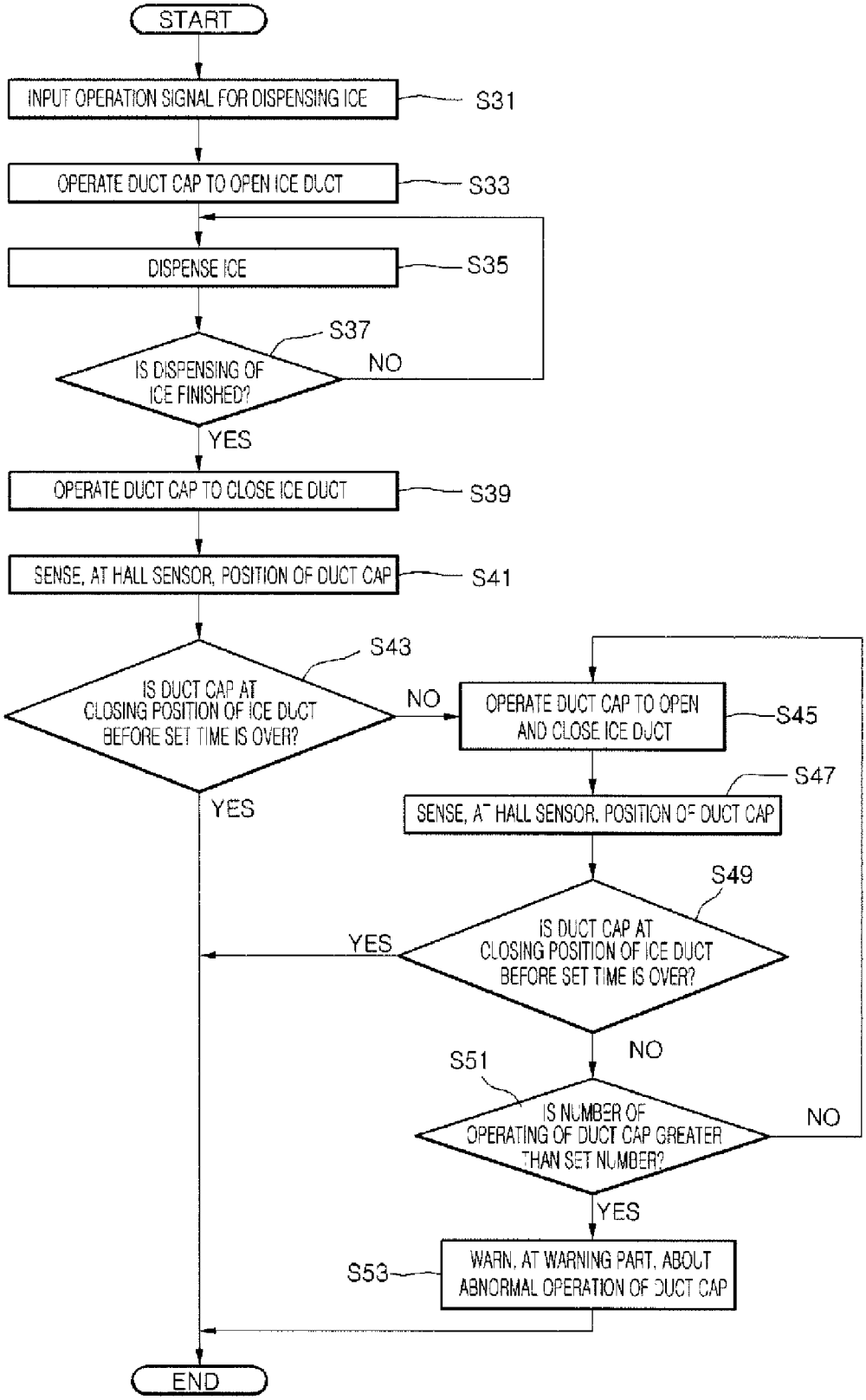
FIG. 8 is a flowchart illustrating a method of controlling an ice-making device.

FIG. 8 illustrates an example of a method of controlling an ice-making device. Referring to FIG. 8, the input part 100 receives an operation signal starting the dispensing of ice through the dispenser (S31). Then, according to the operation signal input to the input part 100, the control part 300 controls the duct cap 20 to open the ice duct 10 (S33), so that the ice is dispensed through the ice duct 10 (S35).

It is determined whether the dispensing of the ice through the ice duct 10 is finished (S37). When it is determined that the dispensing of the ice through the ice duct 10 is finished, the control part 300 controls the duct cap 20 to close the ice duct 10 (S39).

When the duct cap 20 starts to operate to close the ice duct 10 (S39), the hall sensor 30 senses a position of the duct cap 20, e.g., a position of the duct cap 20 relative to the ice duct 10 (S41). Based on the sensing (S41), it is determined whether the hall sensor 30 senses that the duct cap 20 has moved to the closing position from the position where the duct cap 20 opens the ice duct 10 prior to a set time expiring (S43). When it is determined that the hall sensor 30 senses that the duct cap 20 is disposed at the closing position prior to the set time expiring (S43), the duct cap 20 has operated normally to close the ice duct 10, and thus the operation of the duct cap 20 is finished.

When it is determined that the hall sensor 30 fails to sense that the duct cap 20 is disposed at the closing position prior to the set time expiring (S43), the control part 300 controls the duct cap 20 to operate to open and close the ice duct 10 (S45). The hall sensor 30 senses a position of the duct cap 20 (S47), e.g., a position of the duct cap 20 relative to the ice duct 10, and it is determined whether the hall sensor 30 senses that the duct cap 20 has moved to the closing position from the position where the duct cap 20 opens the ice duct 10 prior to the set time expiring (S49).

When it is determined that the hall sensor 30 senses that the duct cap 20 is disposed at the closing position prior to the set time expiring (S49), the duct cap 20 has operated normally to close the ice duct 10, and thus the operation of the duct cap 20 is finished.

When it is determined that the hall sensor 30 fails to sense that the duct cap 20 is disposed at the closing position prior to the set time expiring (S49), it is determined whether the number of repeated opening and closing operations of the duct cap 20 is greater than a preset number (S51). When it is determined that the number of the repeated opening and closing operations of the duct cap 20 is the preset number or less (S51), the control part 300 controls the duct cap 20 such that operations associated with reference numerals (S45) to (S51) are repeated.

When it is determined that the number of the repeated opening and closing operations of the duct cap is greater than the preset number (S51), the control part 300 controls the warning part 200 to warn about abnormal operation of the duct cap 20 (S53). The warning part 200 may warn through a lamp on/off, display of characters or symbols, any type of visual display, or an audible output (e.g., a voice output).

Although the ice-making device has been described as being installed in the ice-making chamber disposed on a back surface of the refrigerator compartment door, the present disclosure is not limited thereto. For example, the ice-making device may be installed in an ice-making chamber located inside of the refrigerator compartment door (e.g., within a storage space defined by the refrigerator compartment and separate from the door). Also, the ice-making device may be installed on a back surface of a freezer compartment door or located inside of the freezer compartment door (e.g., within a storage space defined by the freezer compartment and separate from the door).

Although the duct cap has been described as rotating to open or close the ice duct, the duct cap 20 is not limited to a rotating operation to open or close the ice duct. For example, the duct cap may be translated (e.g., slid) to open or close the ice duct.

The ice duct is a member for dispensing the ice, and the duct cap is a member for opening or closing the member for dispensing the ice. Thus, if the above-described functions can be performed, members and/or devices under any names may be substantially denoted as the same configuration as the ice duct and the duct cap.

In some examples, times in which the duct cap fails to close the ice duct because of ice caught between the ice duct and the duct cap may be reduced. This makes it possible to reduce cool air in the refrigerator compartment and the ice-making chamber from being discharged through the ice duct to the outside.

Also, a user may be warned when the duct cap fails to close the ice duct completely even when the operation of the duct cap for opening and closing the ice duct is performed a plurality of times. Thus, the user can remove ice between the ice duct and the duct cap. This may improve operation reliability and efficiency of the dispenser.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An ice-making device comprising:
- a duct through which ice is dispensed;
- a duct-covering part configured to open and close the duct;
- a sensor part configured to sense whether the duct-covering part is positioned to close the duct; and
- a control part configured to control the duct-covering part to open the duct when the sensor part senses that the duct-covering part fails to close the duct and the duct-covering part has been attempting to close the duct for at least a preset period of time, wherein the sensor part comprises:
- a magnet coupled to one of a side of the duct and a side of the duct-covering part; and
- a hall sensor that is coupled to the other of the side of the duct and the side of the duct-covering part and that is configured to sense a magnetic field of the magnet.

2. The ice-making device according to claim 1, wherein the magnet and the hall sensor are positioned such that, when the duct-covering part is positioned to close the duct, the magnet and the hall sensor contact and, when the duct-covering part is positioned to open the duct, the magnet and the hall sensor fail to contact.

3. The ice-making device according to claim 1, wherein the duct-covering part comprises:
- a duct cap; and
- a cap motor configured to rotate the duct cap to open and close the duct.

4. The ice-making device according to claim 3, wherein the control part is configured to rotate the cap motor in a first direction to cause the cap motor to rotate the duct cap to open the duct and rotate the cap motor in a second direction to cause the cap motor to rotate the duct cap to close the duct, the second direction being different than the first direction.

5. An ice-making device comprising:
- a duct through which ice is dispensed;
- a duct-covering part configured to open and close the duct;
- a sensor part configured to sense a position of the duct-covering part relative to the duct; and
- a control part configured to control the duct-covering part to repeat at least once an operation of opening and closing the duct when the sensor part senses that the duct-covering part fails to reach a closing position in which the duct-covering part closes the duct and the duct-covering part has been attempting to close the duct for at least a preset period of time, wherein the sensor part comprises:

a magnet coupled to one of a side of the duct and a side of the duct-covering part; and a hall sensor that is coupled to the other of the duct and the side of the duct-covering part and that is configured to sense a magnetic field of the magnet, the magnet and the hall sensor being positioned such that, when the duct-covering part is positioned to open the duct, the sensor part fails to sense.

6. The ice-making device according to claim 5, wherein the control part is configured to, after controlling the duct-covering part to repeat the operation of opening and closing the duct, reduce the preset period of time used in determining whether to repeat the operation of opening and closing the duct.

7. The ice-making device according to claim 6 wherein the control part is configured to gradually reduce the preset period of time used in determining whether to repeat the operation of opening and closing the duct each time the operation of opening and closing the duct is repeated.

8. The ice-making device according to claim 5, further comprising a warning part configured to output a warning to a user, wherein the control part is configured to determine whether the operation of opening and closing the duct has been repeated a preset number of times and control the warning part to output the warning in response to a determination that the operation of opening and closing the duct has been repeated the preset number of times.

9. The ice-making device according to claim 5, wherein the magnet and the hall sensor are positioned such that, when the duct-covering part is positioned to close the duct, the magnet and the hall sensor contact and, when the duct-covering part is positioned to open the duct, the magnet and the hall sensor fail to contact.

10. The ice-making device according to claim 5, wherein the duct-covering part comprises:

a duct cap; and a cap motor configured to rotate the duct cap to open and close the duct.

11. The ice-making device according to claim 10, wherein the control part is configured to rotate the cap motor in a first direction to cause the cap motor to rotate the duct cap to open the duct and rotate the cap motor in a second direction to cause the cap motor to rotate the duct cap to close the duct, the second direction being different than the first direction.

12. The ice-making device according to claim 5, wherein hall sensor is configured to sense whether the duct-covering part is in a position to close the duct based on whether the magnetic field of the magnet is relatively weak or relatively strong.

13. A method of controlling an ice-making device, comprising:

controlling, using a control part, a duct-covering part to open a duct to allow dispensing of ice;

subsequent to dispensing ice through the duct, controlling, using the control part, the duct-covering part to close the duct;

in response to controlling the duct-covering part to close the duct:

sensing, using a sensor part, whether the duct-covering part is in a position that closes the duct; and determining, using the control part, whether a preset period of time has passed since controlling the duct-covering part to close the duct; and in response to sensing that the duct-covering part is not in a position that closes the duct and determining that the preset period of time has passed since controlling the duct-covering part to close the duct, controlling, using the control part, the duct-covering part to reopen the duct controlling, using the control part, the duct-covering part to repeatedly open the duct and attempt to close the duct until the sensor part senses that the duct-covering part is in a position that closes the duct;

determining, using the control part, whether, in attempting to close the duct, an operation to open and close the duct has been repeated a preset number of times; and using the control part to stop controlling the duct-covering part to repeatedly open the duct and attempt to close the duct in response to a determination that an operation to open and close the duct has been repeated the preset number of times.

14. The method according to claim 13, further comprising, after controlling the duct-covering part to repeat an operation of opening and closing the duct, reducing the preset period of time used in determining whether to repeat the operation of opening and closing the duct.

15. The method according to claim 14 wherein reducing the preset period of time used in determining whether to repeat the operation of opening and closing the duct comprises gradually reducing the preset period of time used in determining whether to repeat the operation of opening and closing the duct each time the operation of opening and closing the duct is repeated.

16. The method according to claim 13, wherein:

the duct-covering part comprises a duct cap and a cap motor configured to rotate the duct cap to open and close the duct, controlling the duct-covering part to open the duct to allow dispensing of ice comprises controlling, using the control part, the cap motor to rotate in a first direction to cause the cap motor to rotate the duct cap to open the duct, and controlling the duct-covering part to close the duct comprises controlling, using the control part, the cap motor to rotate in a second direction to cause the cap motor to rotate the duct cap to close the duct, the second direction being different than the first direction.

17. The method according to claim 13, further comprising:

determining, using the control part, whether, in attempting to close the duct, an operation to open and close the duct has been repeated a preset number of times;

outputting, using a warning part, a warning to a user in response to a determination that an operation to open and close the duct has been repeated the preset number of times.

18. The method according to claim 13, wherein the sensor part comprises:

a magnet coupled to one of a side of the duct and a side of the duct-covering part; and a hall sensor that is coupled to the other of the side of the duct and the side of the duct-covering part and that is configured to sense a magnetic field of the magnet.

* * * * *